US008226455B2

(12) United States Patent
Berryhill

(10) Patent No.: US 8,226,455 B2
(45) **Date of Patent: *Jul. 24, 2012**

(54) VACUUM-ASSISTED SANDING BLOCK

(75) Inventor: Thomas O. Berryhill, Jensen Beach, FL (US)

(73) Assignee: Thomas O. Berryhill, Jensen Beach, FL (US)

( * ) Notice: Subject to any disclaimer, the term of this patent is extended or adjusted under 35 U.S.C. 154(b) by 678 days.

This patent is subject to a terminal disclaimer.

(21) Appl. No.: 12/348,059

(22) Filed: Jan. 2, 2009

(65) Prior Publication Data

US 2009/0124177 A1 May 14, 2009

Related U.S. Application Data

(63) Continuation-in-part of application No. 11/750,576, filed on May 18, 2007, now Pat. No. 7,473,165.

(60) Provisional application No. 60/803,431, filed on May 30, 2006.

(51) Int. Cl.

| | |
|---|---|
| ***B34B 1/00*** | (2006.01) |
| ***B24B 55/06*** | (2006.01) |
| ***B24B 15/00*** | (2006.01) |

(52) U.S. Cl. ..... 451/59; 451/456; 451/524

(58) Field of Classification Search ..... 451/59, 451/456, 451, 344, 350, 354, 356, 357, 523, 451/524

See application file for complete search history.

(56) References Cited

U.S. PATENT DOCUMENTS

| | | | | |
|---|---|---|---|---|
| 4,549,371 | A * | 10/1985 | Hakoda | 451/456 |
| 4,779,385 | A * | 10/1988 | Reiter | 451/354 |
| 4,937,984 | A * | 7/1990 | Taranto | 451/456 |
| 5,283,988 | A * | 2/1994 | Brown | 451/456 |
| 7,249,996 | B1 * | 7/2007 | Volyar | 451/354 |
| 7,364,500 | B2 * | 4/2008 | Brown | 451/456 |
| 7,815,494 | B2 * | 10/2010 | Gringer et al. | 451/354 |

* cited by examiner

*Primary Examiner* — Hadi Shakeri
(74) *Attorney, Agent, or Firm* — James David Johnson, P.A.; James David Johnson

(57) ABSTRACT

A vacuum-assisted sanding device removably connectable to a conventional sanding pad of the type used with mechanical sanders. The sanding device may include a swiveling connection tube for connecting dust removal channels and a recess of a handle block of the sanding device to a vacuum system. The manual sanding device may also include a plate system for suctioning away dust and other particulate matter created during the sanding process.

16 Claims, 12 Drawing Sheets

VACUUM-ASSISTED SANDING BLOCK

CROSS-REFERENCE TO RELATED APPLICATIONS

The present application is a continuation-in-part of U.S. patent application Ser. No. 11/750,576 filed on May 18, 2007, which claims the priority of U.S. provisional patent application number 60/803,431 filed on May 30, 2006. The foregoing applications are incorporated in their entirety herein by reference.

FIELD OF THE INVENTION

The invention relates to devices and methods for capturing and disposing of dust and other particulate matter created during sanding. More particularly, the invention relates to methods and devices for removing dust and other particles produced during sanding using a vacuum-assisted sanding block.

BACKGROUND

Conventional manual sanding blocks and mechanical sanders produce large quantities of dust and particulate debris as an unsightly, and sometimes dangerous, waste byproduct of the sanding process. Conventional mechanical sanding blocks and equipment that include dust removal components are often difficult to maneuver into corners and may include expensive parts. Many conventional mechanical sanders also do not include a compact lightweight handle that may be easily manipulated manually to enhance the maneuverability of the sander over a surface. Both rectangular and circular mechanical sanders are often moved and controlled using a rigid elongated handle that extends off of and away from a motor for the sander that is disposed above the sander and sanding pad. The motor, which is constructed from metal, is heavy and inhibits the maneuverability of the conventional mechanical sander. The rigid elongated handle also inhibits maneuverability of the sander because the handle is often hollow and may double as a hose for connection of the mechanical sander to a vacuum. These handle/hose combinations lack any means for swiveling, rotating, or otherwise improving the flexibility and moveability of the sander thereby rendering them unwieldy and difficult to use when sanding surfaces having numerous corners. A user will also tire quickly when using conventional mechanical sanders due to the weight of the motor that also must be pushed and pulled using the rigid handle attached thereto. Thus, efficiency is reduced as a result of the unnecessary weight and lack of maneuverability of conventional mechanical sanders.

A need exists for a lightweight, highly maneuverable manual sanding device having a connection for a vacuum, to which sanding pads used with conventional mechanical sanders may be attached.

SUMMARY

The invention relates to a vacuum-assisted, manual sanding block having a handle block for grasping, a top plate, a bottom plate, and a center separator plate disposed securely between the top and bottom plates. The manual sanding block further includes a swiveling connection tube for connecting an aperture and channel suctioning system of the manual sanding block to a vacuum system. Any commercially available vacuum system may be connected to the manual sanding block to provide the required vacuum force. The handle block is constructed with attachment means to permit fastening of the handle block to a conventional sanding pad of the type used with commercially available mechanical sanders.

The ergonomically-shaped handle block includes a top surface that is gripped by the user while sanding an object and a bottom surface. A top surface of the top plate is securely attached to the bottom surface of the handle block. The top plate includes an aperture penetrating the top and bottom surfaces of the top plate and a channel on the bottom surface connected at one end to the aperture and having a terminal end terminating at the center of the bottom surface of the top plate. The swiveling connection tube is connected to the aperture on the top surface of the top plate within a mounting recess in the handle block that exposes the top surface of the top plate.

A top surface of the center separator plate is securely attached to the bottom surface of the top plate. The center separator plate includes a centrally located aperture that extends entirely through the separator plate. A bottom surface of the center separator plate is securely attached to a top surface of the bottom plate. The central aperture of the center separator plate ensures that the suctioning force of the connected vacuum system is evenly distributed through all of a plurality of apertures penetrating through the bottom plate.

A top surface of the bottom plate includes a plurality of channels that are interconnected with each other and with the plurality of apertures that penetrate the top surface and exit through a bottom surface of the bottom plate. In one embodiment, the top surface of the bottom plate includes two longitudinal channels intersected in the middle by a transverse channel. The aperture of the center separator plate can be disposed over the point of intersection between the longitudinal channel of the bottom plate and the middle transverse channel, thereby providing maximum suctioning force to all of the bottom plate apertures. A piece of sand paper is attached to the bottom surface of the bottom plate. The sand paper includes apertures corresponding in location so as to be aligned with the apertures through the bottom plate.

The swiveling connection tube of the manual sanding block includes a free end and a threaded end that is connected to the aperture of the top plate where the top plate aperture is exposed within the mounting recess of the handle block. The swiveling connection tube may also be used with circular mechanical sanders to provide easier maneuverability of the mechanical sander in corners and at angles.

The current invention uses inexpensive parts to create a system for removing dust created during the sanding process using a manual sanding block. The invention also provides a device that permits both manual and mechanical sanding blocks having vacuum-assist features to be easily maneuvered within corners and at angles.

One advantage of this invention is that the vacuum-assisted manual sanding block provides a lightweight, inexpensive and effective device for suctioning away and removing dust and particulate matter produced by sanding the surface of an object.

Another advantage of the invention is that the manual sanding block provides a lightweight, inexpensive and effective sanding device for maneuvering into corners and at angles during use in the sanding process.

Still another advantage of the invention is that the manual sanding block provides a lightweight, inexpensive and effective device that can be attached to and used with conventional sanding pads such as, for example, the sanding pads typically attached to mechanical sanders.

Yet another advantage of the invention is that the manual sanding block may be connected to a conventional sanding pad of the type typically used with a mechanical sander so that a conventional mechanical sanding pad can be adapted for usage with a manual sanding handle that is vacuum-assisted.

Accordingly, the invention features a sanding device that includes a handle block and a swiveling connection tube. The handle block further includes a top surface that can be manually grasped, a bottom surface that is attachable to a sanding pad, attachment means for securing the sanding pad to the bottom surface, and an aperture that passes through a side of the top surface and exits the bottom surface of the handle block. The swiveling connection tube can be attached to the top surface at the aperture to connect the handle block to a vacuum system.

In another aspect, the invention features the sanding pad being a conventional sanding pad of a type that is connectable to a mechanical sander.

In another aspect, the invention features the handle block and sanding pad being circular in shape.

In another aspect, the invention features the handle block and sanding pad being rectangular in shape.

In another aspect, the invention features the attaching means including at least one threaded aperture.

In another aspect, the invention features the sanding pad including at least one screw or stud with each screw or stud being inserted into one of the threaded apertures of the handle block to fasten the handle block to the sanding pad.

In another aspect, the invention features the bottom surface of the handle block having a central channel that begins at the aperture of the handle block.

In another embodiment, the invention features a sanding device that includes a handle block, a top plate, a center separator plate, a bottom plate, and a swiveling connection tube. The handle block can be used to manually grasp the sanding device and includes a top surface, a bottom surface, and a handle block aperture. The top plate may be attached to the bottom surface of the handle block and includes a top surface, a bottom surface, and a top plate aperture in communication with the handle block aperture. The center separator plate may be attached to the bottom surface of the top plate and includes a top surface, a bottom surface, and a center separator plate aperture in communication with the top plate aperture. The bottom plate may be attached to the bottom surface of the center separator plate and includes a top surface, a bottom surface, and a plurality of bottom plate apertures in communication with the center separator plate aperture. The swiveling connection tube can be interconnected between a vacuum system and the handle block aperture of the handle block.

In another aspect, the invention features the sanding device further including a conventional sanding pad of a type that is connectable to a mechanical sander. The sanding pad can be attached to the bottom surface of the bottom plate.

In another aspect, the invention features the bottom surface of the bottom plate further including a plurality of recesses. Each recess can extend from one of the plurality of bottom plate apertures to a longitudinal side of the bottom plate.

In another aspect, the invention features each of the plurality of bottom plate recesses having side walls that converge from one of the plurality of bottom plate apertures to a narrower opening at the closest longitudinal side of the bottom plate.

In another aspect, the invention features the bottom surface of the top plate further including a central channel that begins at the top plate aperture.

In another aspect, the invention features the bottom surface of the top plate further including a longitudinal channel surrounding, but more shallow than, the central channel.

In another aspect, the invention features the bottom surface of the top plate. further including a recess.

In another aspect, the invention features the recess being separated from the central channel and top plate aperture by a ridge that is flush with the bottom surface of the bottom plate.

In another aspect, the invention features the handle block being constructed from a rigid, durable, lightweight material.

In another aspect, the invention features the material from which the handle block is constructed being a lightweight, high-density foam.

In another aspect, the invention features the handle block, top plate, center separator plate, and bottom plate forming a permanently-connected, unitary, single-piece unit that is removably connectable to the sanding pad.

The invention also features a method of the invention having the steps of: (a) attaching to a manual sanding device a conventional sanding pad of the a type that is connectable to a mechanical sander; (b) connecting the manual sanding device to a vacuum system; (c) grasping the manual sanding device and manually manipulating the sanding device to sand a surface; and (d) removing dust and particulate matter produced during while sanding the surface through the sanding pad and manual sanding device using negative pressure created by the vacuum system.

Another method of the invention includes the manual sanding device featuring a handle block and a swiveling connection tube. The handle block further includes a top surface for manually grasping the handle block, a bottom surface that is attachable to the sanding pad, means for attaching the sanding pad to the bottom surface, and an aperture passing through a side of the top surface and exiting the bottom surface of the handle block. The swiveling connection tube can be attached to the top surface of the handle block at the aperture and is capable of connecting to the vacuum system.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents and other references mentioned herein are incorporated by reference in their entirety. In the case of conflict, the present specification, including definitions will control.

DETAILED DESCRIPTION

Figure 1A:
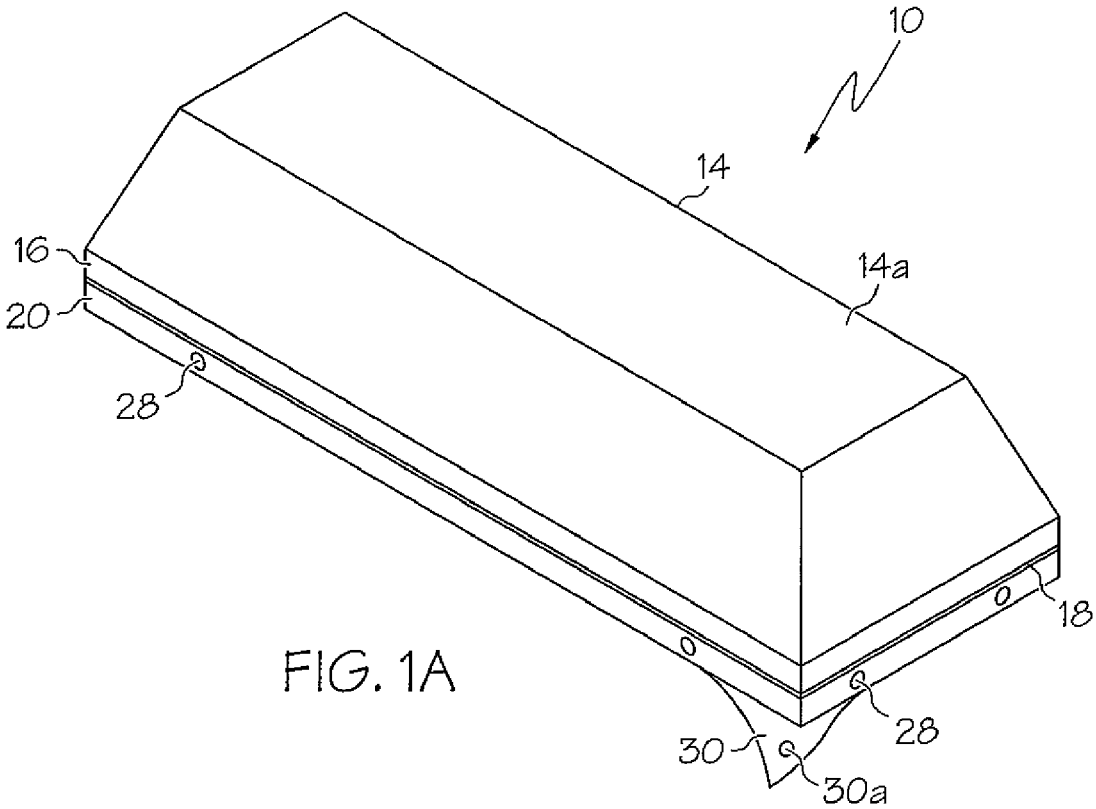
FIG. 1A is a front perspective view of the invention including a manual sanding block.
Figure 1B:
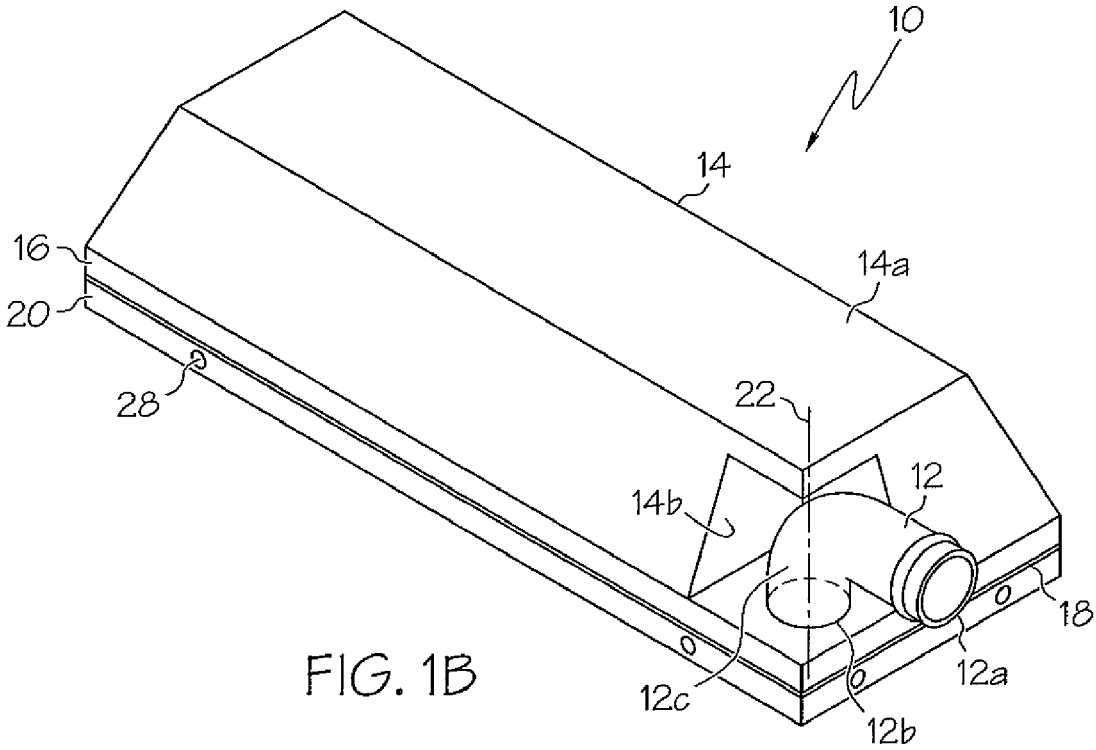
FIG. 1B is a rear perspective view of the invention in FIG. 1A including the manual sanding block and one example of the location for placement of the swiveling elbow joint connection tube.

The invention provides a lightweight, highly maneuverable manual sanding block that can be connected to a vacuum to remove dust and other particulate matter created during sanding and that may be attached to sanding pads used with conventional mechanical sanders. As illustrated in FIGS. 1A and 1B, the invention 10 relates to a vacuum-assisted manual sanding block 10 that includes components for suctioning away dust and particulate matter produced by the sanding process as well as a swiveling, vacuum system connection tube 12 for easier maneuvering of the sanding block 10 in corners and at angles. The manual sanding block 10 includes a handle block 14, a top plate 16, a center separator plate 18, a bottom plate 20, and the swiveling vacuum connection tube 12. The handle block 14 may be of any geometric shape, but in an exemplary embodiment, is of an ergonomic design permitting easy grasping by the user during use in the sanding process. One such ergonomic design for the handle block 14 is illustrated in FIGS. 1A and 1B. The handle block 14 includes a top surface 14*a* for grasping and a bottom surface (not shown in the drawings) for attachment of the top plate 16. The handle block 14 may be constructed from a rigid, durable, lightweight material. In one embodiment of the invention, the handle block 14 is constructed from a lightweight, high density foam. Plastics, wood, metals, metal alloys, and composite materials may also be used to create the handle block 14.

In an alternate embodiment of the invention, the handle block 14 may include one or more recesses within the bottom surface to enhance the suctioning force of the vacuum system as it is applied to the manual sanding block 10.

Figure 6A:
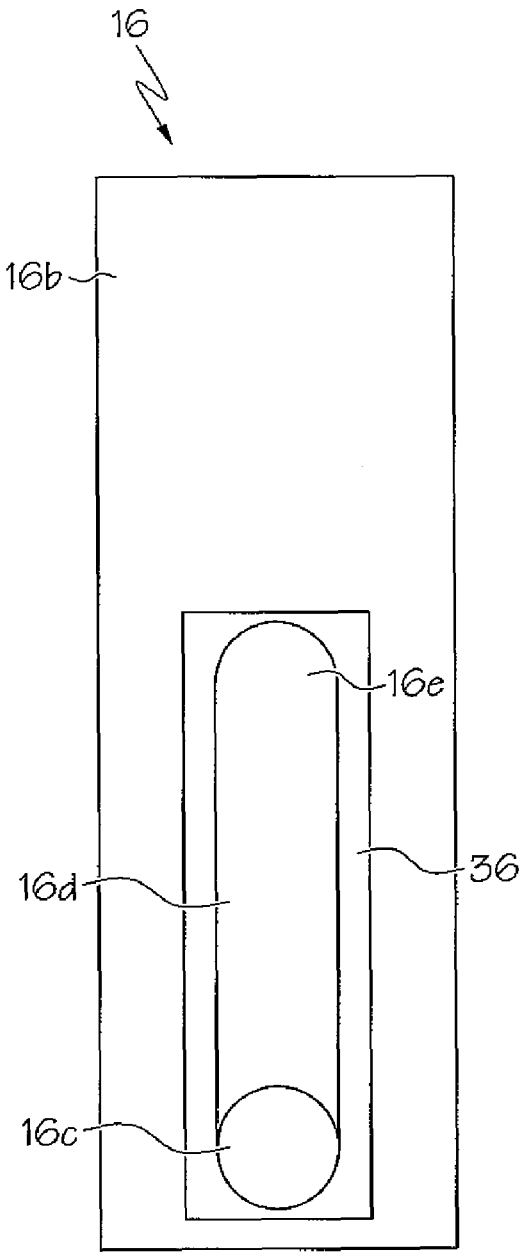
FIG. 6A is a bottom plan view of the top plate in FIG. 6A.
Figure 6B:
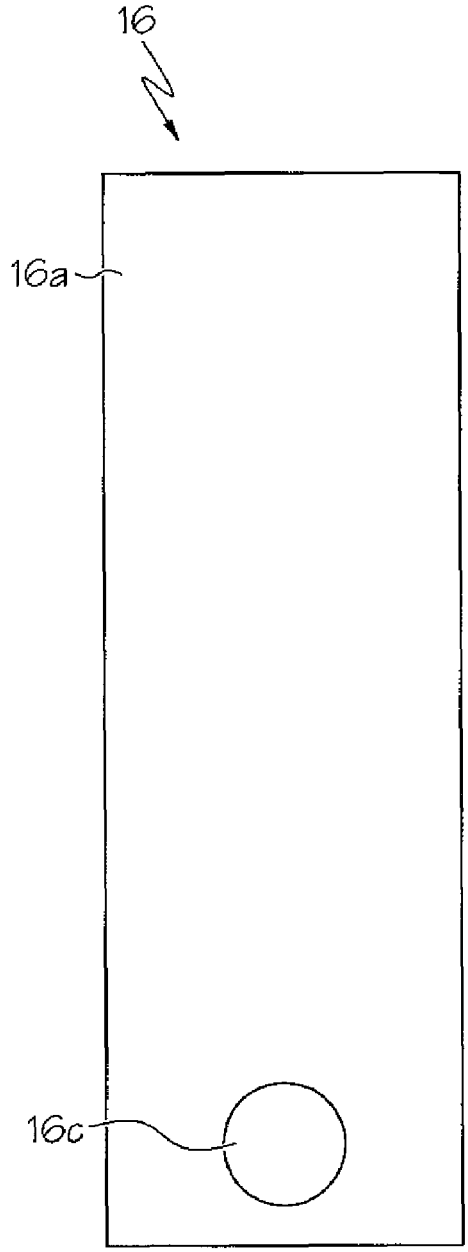
FIG. 6B is a top plan view of another embodiment of a top plate of the invention in FIG. 1A.

The top plate 16, such as the one illustrate in FIGS. 6A and 6B, can be securely attached to the bottom surface of the handle block 14. The top plate 16 can be attached to the handle block 14 by an adhesive or by heat molding and becomes irremovable once attached thereto. In another embodiment of the top plate 16 illustrated in FIGS. 6A and 6B, the top plate 16 may include a top surface 16*a* and a bottom surface 16*b*. The top plate 16 further includes an aperture 16*c* extending entirely through the top surface 16*a* and exiting the bottom surface 16*b* of the top plate. In one embodiment of the invention, the bottom surface 16*b* of the top plate 16 includes a channel 16*d* in communication with the aperture 16*c*. The channel 16*d* includes a terminal end 16*e* terminating on or near the center of the bottom surface 16*b* of the top plate 16. The bottom surface 16*b* of the top plate 16 may further include a countersunk recess 36 (shown in FIG. 6A) that surrounds and overlaps the deeper channel 16*d*. The recess 36 is sized and shaped to receive the insertion of the center separator plate 18 which fits inside the recess flush with the bottom surface 16*b*.

Figure 4:
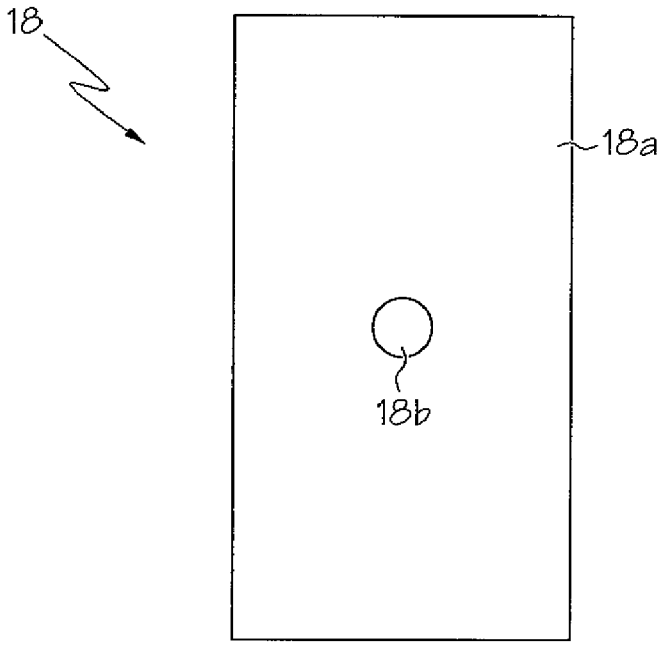
FIG. 4 is a top plan view of a center separator plate of the invention in FIG. 1A. The bottom plan view of the center separator plate is identical in appearance.
Figure 7:
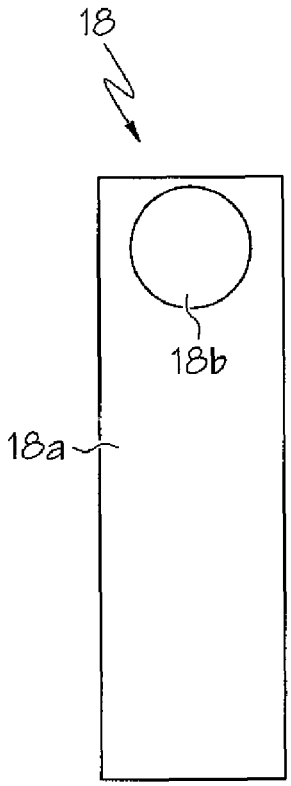
FIG. 7 is a top plan view of another embodiment of a center separator plate of the invention in FIG. 1A. The bottom plan view of the center separator plate is identical in appearance.

A top surface 18*a* of the center separator plate 18 is securely attached to the bottom surface 16*b* of the top plate 16. The center separator plate 18 includes the top surface 18*a*, a bottom surface (not shown in the drawings but, in most embodiments, identical to the top surface 18*a*), and an aperture 18*b* that is in communication with the aperture 16*c* of the top plate 16. In one embodiment of the sanding block 10, the center separator plate 18 is constructed in a smaller size and shape than that of the top plate 16 so that the center separator plate fits within the countersunk recess 36 of the top plate as illustrated in FIG. 7. In this embodiment, the aperture 18*b* of the center separator plate 18 is located through one end of the plate 18 so as to allow alignment of the aperture 18*b* with terminal end 16*e* of channel 16*d* of the top plate 16. In alternate embodiments, the center separator plate 18 may be constructed in the same size and shape as the top plate 16 with the aperture 18*b* being located through the center of the separator plate as shown in FIG. 4. In one embodiment, the center separator plate 18 can be constructed from a thin, semi-rigid material that is irremovably disposed between the top plate 16 and the bottom plate 20 of the sanding block 10. The center separator plate 18 may be attached to the top plate 16 by an adhesive or by heat molding. The aperture 18*b* of the center separator plate 18 communicates with the aperture 16*c* of the top plate 16 by direct alignment with the top plate aperture 16*c* or, in one embodiment, by communication with the terminal end 16*e* of the channel 16*d* of the top plate 16.

Figure 5A:
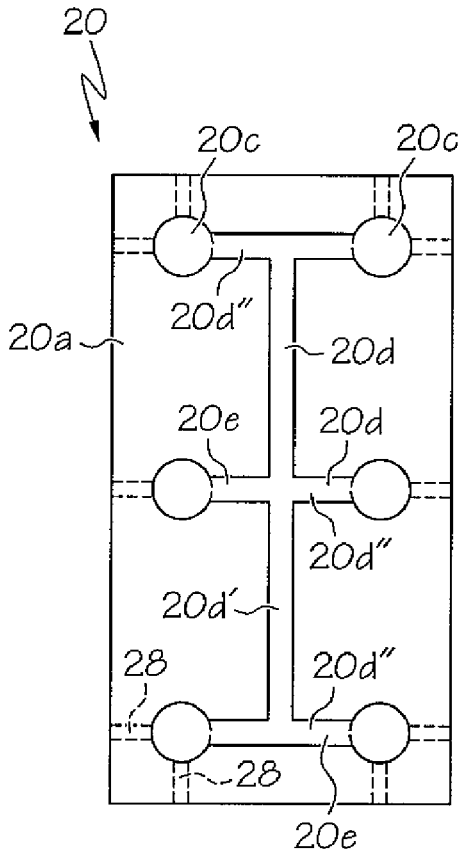
FIG. 5A is a top plan view of a bottom plate of the invention in FIG. 1A.
Figure 5B:
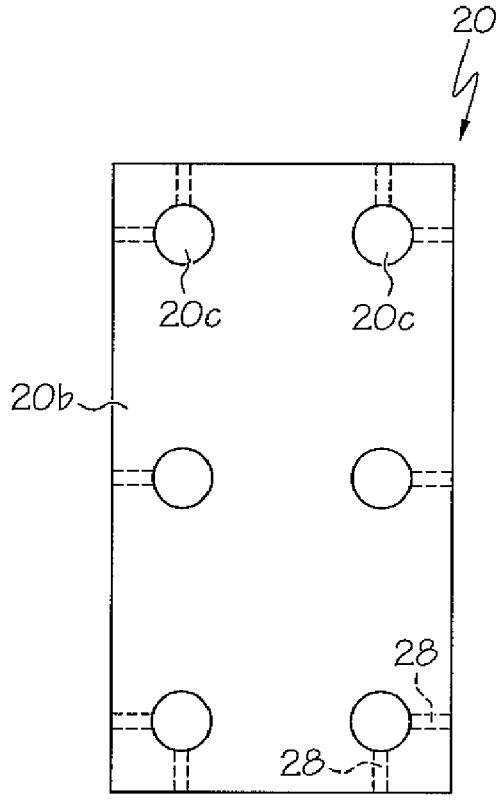
FIG. 5B is a bottom plan view of the bottom plate in FIG. 5A.
Figure 8:
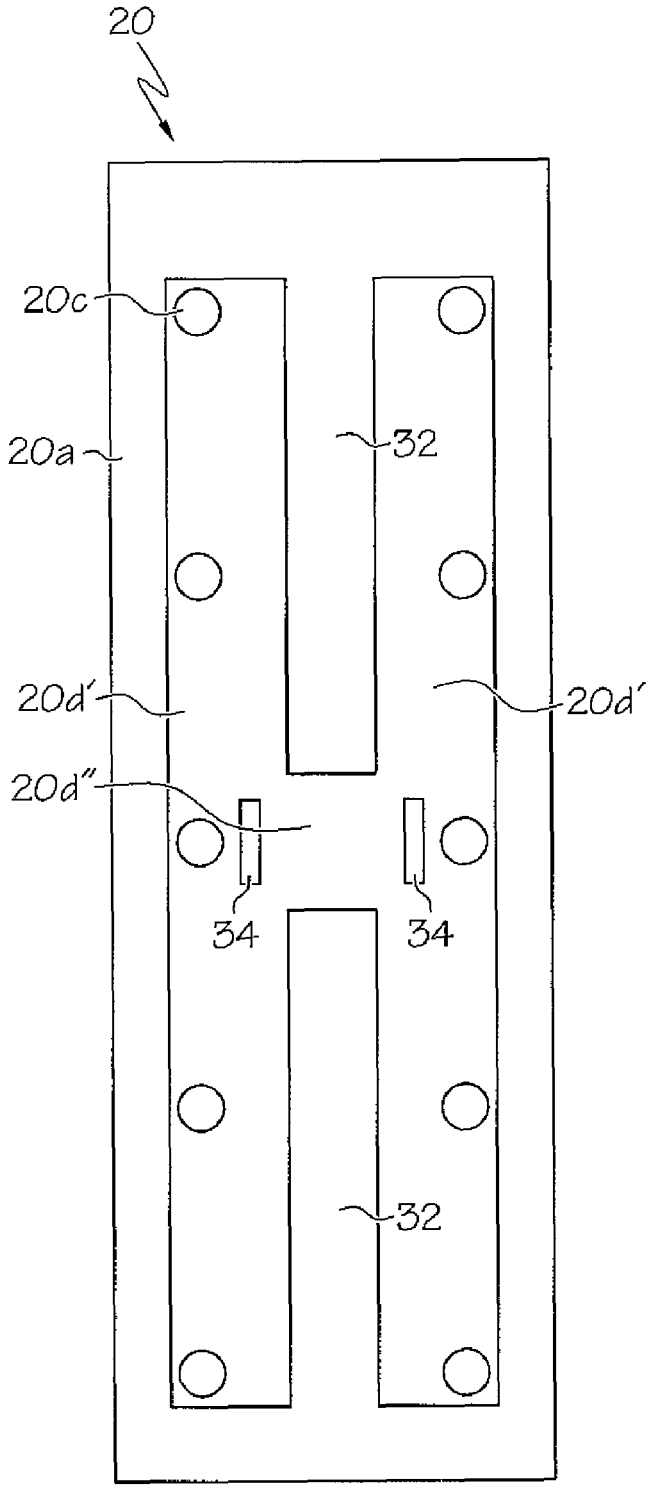
FIG. 8 is a top plan view of another embodiment of a bottom plate of the invention in FIG. 1A.

The bottom plate 20, illustrated in FIGS. 5A, 5B, and 8, is securely attached to the bottom surface of the center separator plate 18. The bottom plate 20 includes a top surface 20*a*, a bottom surface 20*b*, and a plurality of apertures 20*c* extending through the top surface 20*a* and exiting the bottom surface 20*b* of the bottom plate. The top surface 20*a* of the bottom plate 20 can be attached to the bottom surface of the center separator plate 18 by an adhesive or by heat molding. In one embodiment of the invention, the bottom plate 20 becomes irremovable once attached to the center separator plate 18. The top surface 20*a* of the bottom plate 20 includes a plurality of interconnected channels 20*d* connecting to the plurality of apertures 20*c* extending through the bottom plate. The channels 20*d* are shallow grooves cut or molded into the top surface 20*a* of the bottom plate 20. In the embodiment shown in FIG. 8, the top surface 20*a* of the bottom plate 20 includes two longitudinal channels 20*d*' and a central transverse channel 20*d*" that connects the longitudinal channels. In this embodiment, the longitudinal channels 20*d*' are separated by one or more wall elements 32 that act as support structures to prevent the top plate 16 and center separator plate 18 from collapsing into the cavity formed by channels 20*d*' and 20*d*" when the user is applying pressure downward on the unit 10 during use. As illustrated in FIG. 8, the invention may further includes two block elements 34 that distribute the suction force or draw more evenly among the apertures 20*c* so that the most centrally-located apertures (which are nearest to and partially blocked by the block elements 34) do not create the greatest suction force thereby reducing the suction force of the remaining apertures 20*c*. The block elements also serve as support structures to prevent the top plate 16 and center separator plate 18 from collapsing into the channels 20*d* as pressure is applied downward on the unit 10 by the user during use.

An alternate arrangement of the channels 20*d*, shown in FIG. 5B, has one longitudinal channel 20*d*' and three evenly spaced transverse channels 20*d*". Each transverse channel 20*d*' in this embodiment includes two opposing terminal ends 20*e* and each terminal end 20*e* connects to one of the apertures 20*c* (in this embodiment, six apertures in total) that extends through the bottom plate 20. Other channel configurations and other numbers of channels and apertures are contemplated by the invention as long as each aperture 20*c* is in communication with a channel 20*d*.

When connected together, the central aperture 18*b* of the. center separator plate 18 is positioned over the longitudinal channel 20*d*' or over the intersection of the longitudinal and middle transverse channels 20*d*' and 20*d*" of the bottom plate 20. This arrangement permits maximum vacuum force to be applied through each of the apertures 20*c* of the bottom plate 20 so that the vacuum force is distributed evenly through each of the apertures 20*c* to most effectively suction sanding dust from the surface of the object being sanded.

The bottom plate 20 may also include a plurality of side apertures 28 that extend through the sides of the bottom plate and exit into the nearest aperture 20*c*. The side apertures 28 are drilled through the sides of the bottom plate 20 to permit the inflow of air into the apertures 20*c* and the channels 20*d* that is necessary to provide a vacuum force of sufficient force to effectively remove sanding dust and particulate matter created by the sanding process.

A sheet of sand paper or sanding material 30 is securely fastened to the bottom surface 20*b* of the bottom plate 20. The sheet of sand paper includes a plurality of apertures 30*a* (shown in FIG. 1) that corresponds in number and in location with those of the apertures 20*c* of the bottom plate 20. The apertures of the sand paper are aligned with the apertures 20*c* exiting the bottom surface 20*b* of the bottom plate 20, and the sheet of sand paper is attached to the bottom surface by an adhesive backing. In another embodiment of the invention, the sheet of sand paper may include either hook fasteners or loop fasteners for attachment to the bottom plate 20 of the sanding block 10. In that embodiment, the bottom surface 20*b* of the bottom plate 20 may be fitted with an appropriate layer or patches of hook fasteners or loop fasteners for engaging the fasteners of the sand paper. Adhesives or patches of hook and loop fasteners are conventionally used to attach sand paper to the bottom of a sanding block, and thus, are not illustrated in the drawings.

The top plate 16, center separator plate 18, and bottom plate 20 can be constructed from a rigid, durable, lightweight material. Suitable construction materials include but are not limited to polymer foams, including lightweight, high density foam, plastics, wood, metals, metal alloys, and composite materials. The same construction material may be used to create the top plate 16, the center separator plate 18, and the bottom plate 20, or each of these components may be constructed from different materials. These components may also be constructed from the same or from different materials as that used in the construction of the handle block 14.

FIG. 1B illustrates the swiveling connection tube 12 of the sanding block 10 for connecting the manual sanding block 10 to a vacuum system (not shown in the drawings). The handle block 14 may include an appropriately sized and shaped mounting recess 14*b* that exposes the aperture 16*c* through the top surface 16*a* of the top plate 16. The swiveling connection tube 12 is securely attached to the aperture 16*c* within this recess 14*b*. The mounting recess 14*b* may be positioned in one corner of the block handle 14 of the manual sanding block 10 or may be located along one side of the handle block 14. However, the mounting recess 14*b* must be located to expose the aperture 16*c* of the top plate 16 to which the swiveling connected tube 12 is attached. The swiveling connection tube 12 includes a rigid, elbow-shaped tube 12 with one free end 12*a* and one threaded end 12*b* that is screwed into the aperture 16*c* of the top plate 16, the aperture 16*c* also being threaded. Alternatively, the swiveling connection tube 12 may be constructed with conventional features that permit the end 12*b* of the tube 12 to snap into aperture 16*c* rather than including threading to be screwed into the aperture. The free end l2*a* of the swiveling connection tube 12 is the point of attachment for a vacuum system hose or tube (not shown in the drawings). The swiveling connection tube pivots at least 90 degrees or more around an axis 22 extending through the center of a vertical segment 12*c* of the tube 12. The swiveling connection tube can pivot 180 degrees around the axis 22. The pivoting action, or swiveling motion, of the connection tube 12 permits the user to maneuver the sanding block 10 more easily into corners and at angles.

An adapter may be used to attach vacuum system hoses of larger or smaller diameters than the swiveling connection tube to the connection tube 12. A flexible connection hose that swivels may be used in place of the more rigid swiveling connection tube.

Figure 2A:
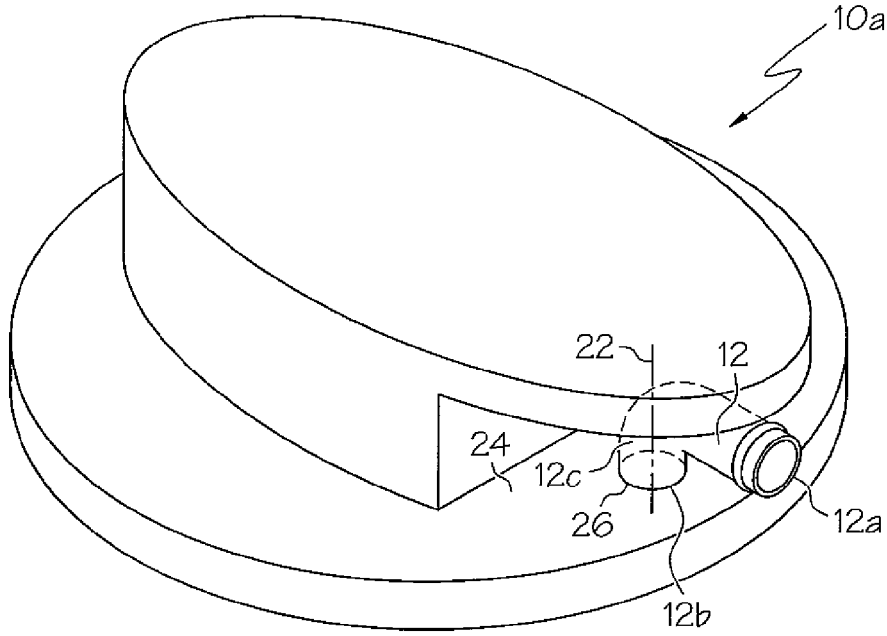
FIG. 2A is a rear perspective view of another embodiment of the invention used with a circular mechanical sander.

In another embodiment of the invention (shown in FIGS. 2A and 2B), a circular sanding device 10*a*, or handle, constructed for use with a circular mechanical sander includes a mounting recess or mounting surface 24 having an aperture 26 to which a swiveling connection tube 12 is attached for connecting the mechanical sanding device 10*a* to a vacuum system. As with the manual sanding device 10, the swiveling connection tube 12, when used with the circular sanding device 10*a*, permits the user to maneuver the sanding device handle 10*a* more easily into corners and at angles.

Although the handle block 14, top plate 16, bottom plate 20, and center separator plate 18 of the above-described vacuum-assisted, manual sanding block 10 are permanently connected in the described sequence, other configurations of the sanding block may also be constructed. In one embodiment of the invention, the handle block, top plate, bottom plate, and center separator plate may be constructed as one suctioning unit by molding or by the use of an adhesive.

In another embodiment of the invention, one or more of the handle block, top plate, bottom plate, and center separator plate may be constructed as two or more units that include fasteners for securely engaging each constructed unit with the appropriate surface of the appropriate corresponding unit in the manner and sequence described in the specification above. The units may each be constructed as separate single-piece components using an adhesive or by molding.

Figure 9:
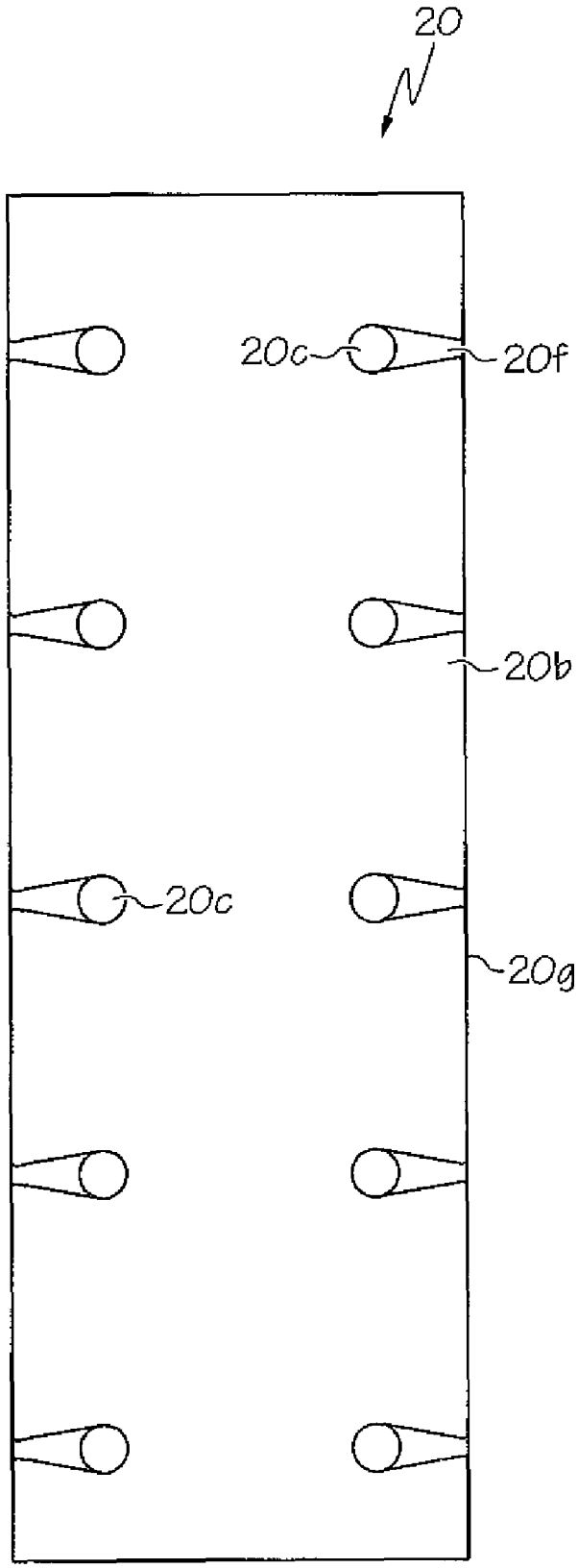
FIG. 9 is a bottom plan view of the bottom plate in FIG. 8.

In an exemplary embodiment of the bottom plate 20, shown in FIG. 8, the bottom plate may feature a bottom surface 20*b* such as that shown in FIG. 9. The bottom surface 20*b* of the bottom plate 20 may include a plurality of apertures 20*c* passing entirely through the top surface 20*a* and bottom surface 20*b* of the bottom plate. The bottom surface 20*b* of the bottom plate 20 may also feature a plurality of recesses 20*f*. Each recess 20*f* extends from one of the plurality of apertures 20*c* to a longitudinal side 20*g* of the bottom plate. Together with one of the plurality of apertures 20*c*, each recess 20*f* forms a teardrop-shaped cavity in the bottom surface 20*b* of the bottom plate 20 so that the side walls of each recess converge from the wider aperture to a more narrow opening at one of the longitudinal sides 20*g* of the bottom plate.

Figure 10:
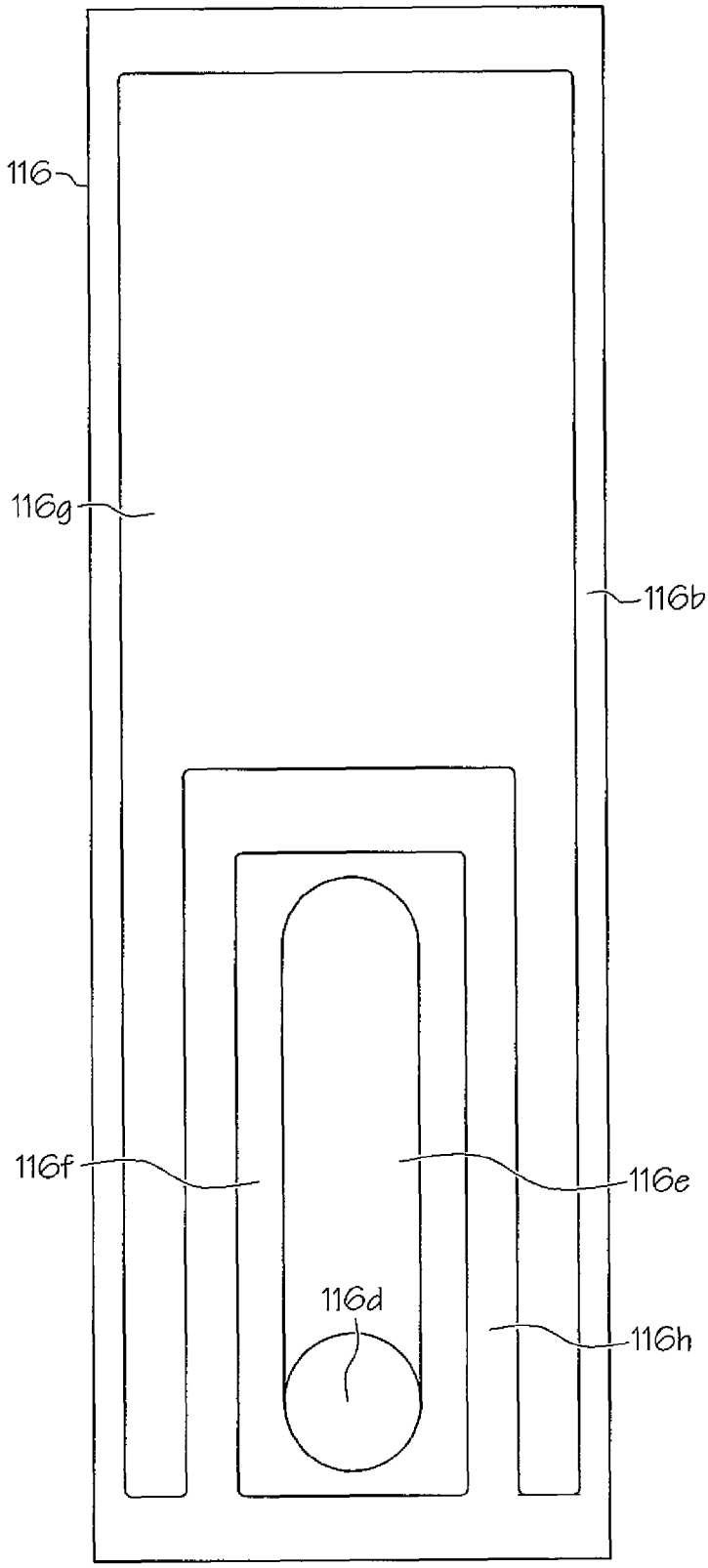
FIG. 10 is a bottom plan view of an exemplary embodiment of a top plate of the invention.

An exemplary embodiment of a top plate 116, shown in FIG. 10, features a bottom surface 116*b* including a central channel 116*e* that begins at the aperture 116*d* of the handle block. The bottom surface 116*b* may further include a longitudinal channel 116*f* surrounding, but more shallow than, the central channel 116*e*. The bottom surface 116*b* of the top plate 116 can also include a recess 116*g*, which may be separated from the central channel 116*e* and aperture 116*d* by a ridge 116*h* that is flush with the bottom surface 116*b*. The central channel, longitudinal channel, and recess allow air inflow to suction dust and particulate matter produced during sanding into the aperture 116*d* of the top plate 116. The central channel 116*e*, longitudinal channel 116*f*, and recess 116*g* are designed to maximize the effectiveness of the vacuum suctioning effect produced within the handle block 14 while connected to a vacuum system.

Figure 11A:
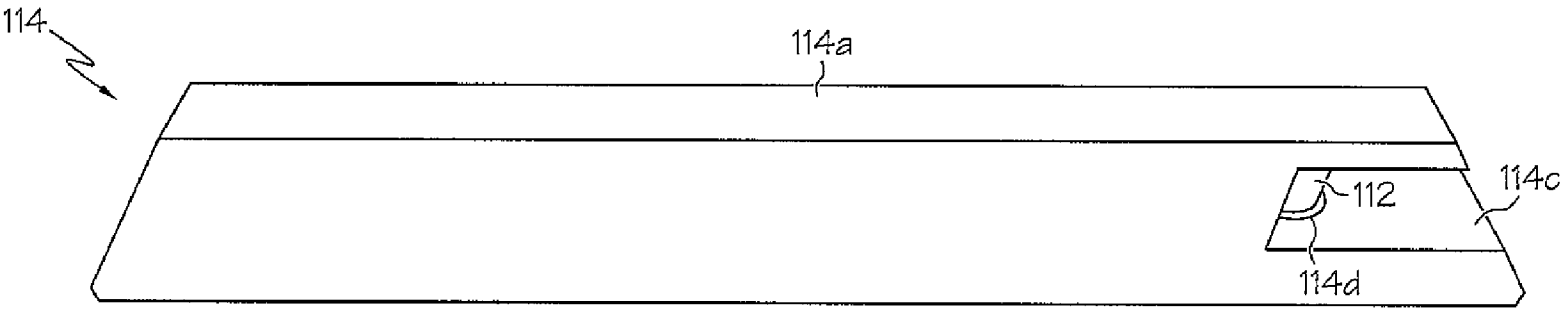
FIG. 11A is a perspective view of an exemplary embodiment of a handle block of the invention.
Figure 11B:
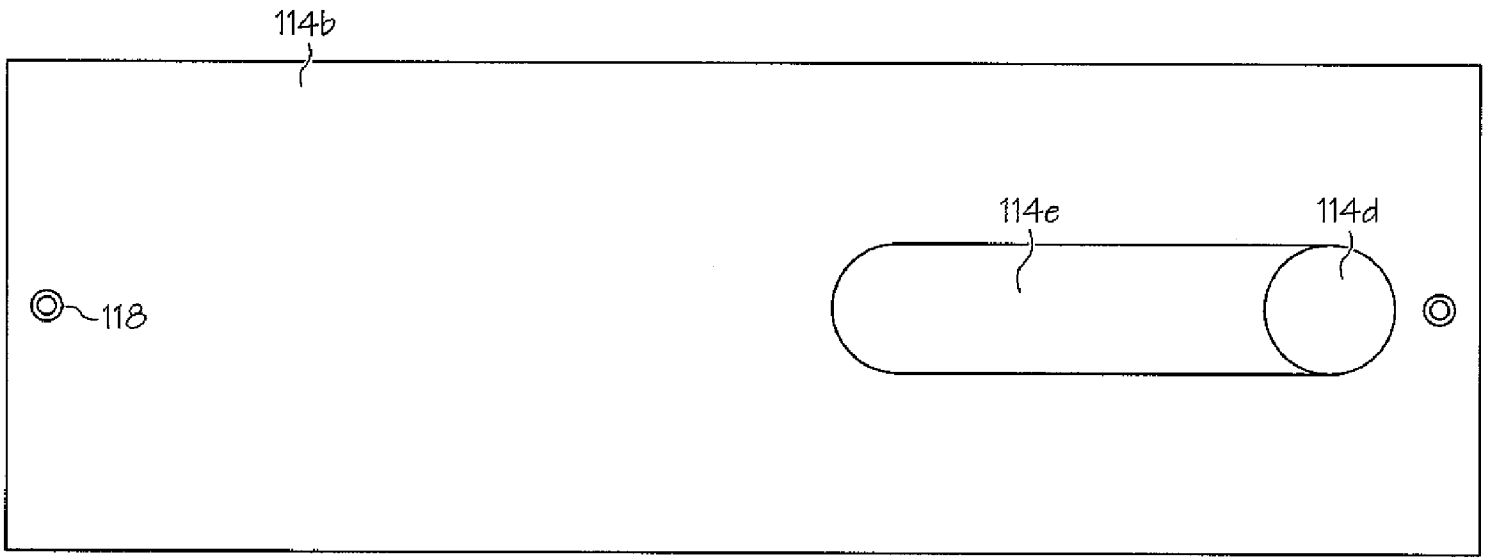
FIG. 11B is a bottom plan view of the handle block in FIG. 11A.
Figure 12:
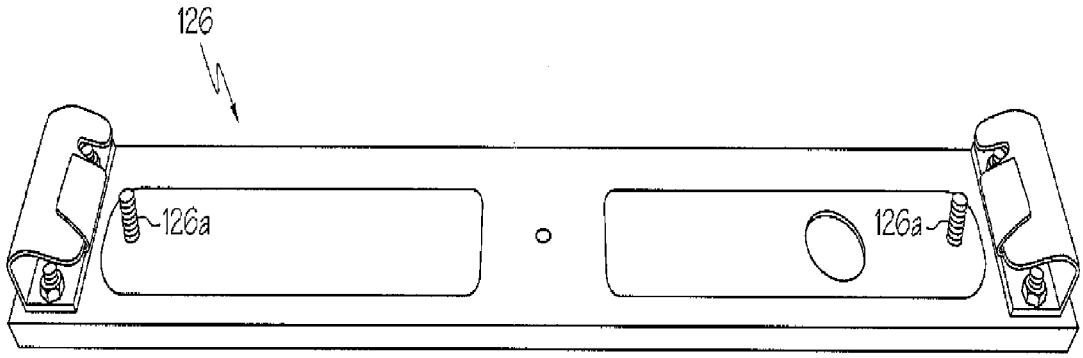
PRIOR ART FIG. 12
FIG. 12 is a perspective view of a conventional mechanical sanding pad.
Figure 13:
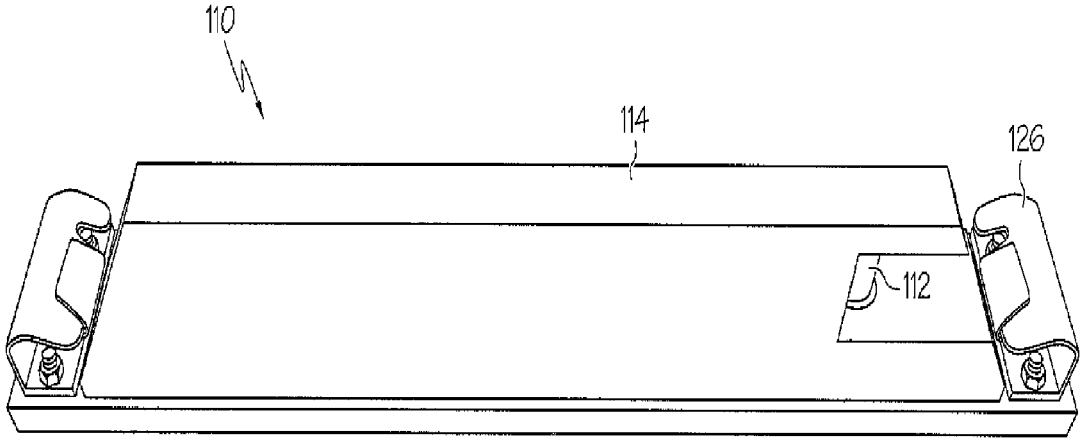
FIG. 13 is a perspective view of the handle block of FIG. 11A attached to the conventional mechanical sanding pad of FIG. 12.

The invention also relates to a sanding device 110 (FIG. 13) that includes a handle block 114 as shown in FIGS. 11A and 11B, a swiveling connection tube 112, and a conventional sanding pad 126 such as, for example, those that are already commercially available. FIG. 12 illustrates one example of a commercially available sanding pad, usually attached to a mechanical sander, to which the handle block 114 can be attached. In this way, the invention can be utilized without the plates described above simply by attaching the handle block 114 to the conventional sanding pad 126, and permits the mechanical sanding pad to be adapted for manual usage. The handle block 114 includes a top surface 114*a* that can be manually grasped, a bottom surface 114*b* that is attachable to a sanding pad 126, attachment means 118 for securing the sanding pad 126 to the bottom surface 114*b*, and an aperture 114*d* that passes through a side 114*c* of the top surface 114*a* and exits the bottom surface 114*b* of the handle block. The aperture 114*d* may be disposed within a recess present in the side 114*c* of the handle block 114. The swiveling connection tube 112 can be attached to the top surface 114*a* at the aperture 114*d* to connect the handle block 114 to a conventional vacuum system. In an exemplary embodiment, the bottom surface 114*b* of the handle block 114 further includes a channel-shaped central recess 114*e* that begins at and communicates with aperture 114*d* and extends longitudinally across the bottom surface 114*b*. The central recess 114*e* allows the vacuum suction force within handle block 114 to capture and remove dust and particulate matter into aperture 114*d* more effectively. FIG. 13 shows the handle block 114 attached to the conventional sanding pad 126.

In the exemplary embodiment shown in FIG. 11B, the attachment means includes at least one threaded aperture 118 into which one or more studs 126*a* of the conventional mechanical sanding pad 126 may be fitted to secure the handle block 114 to the sanding pad 126. Other possible attachment means include screws, nuts and bolts, latches, and any other suitable fastening means.

Figure 2B:
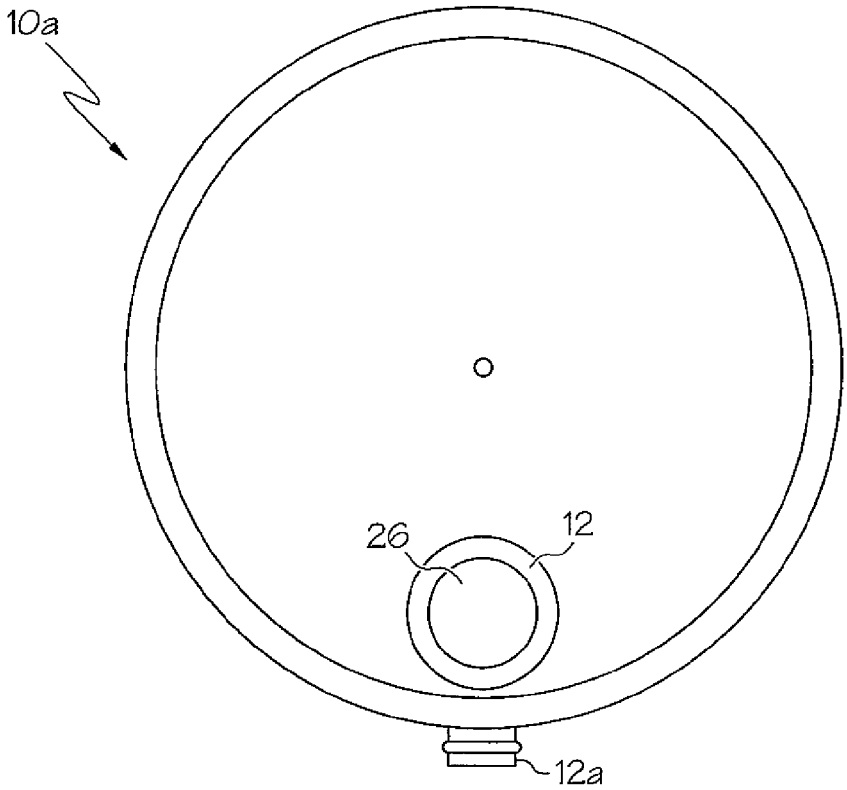
FIG. 2B is a bottom plan view of the embodiment of the invention in FIG. 2A used with the circular mechanical sander.
Figure 3A:
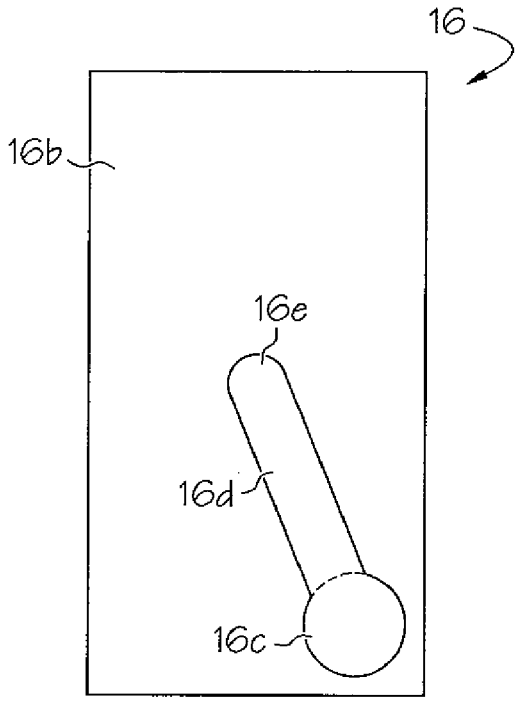
FIG. 3A is a bottom plan view of a top plate of the invention in FIG. 1A.
Figure 3B:
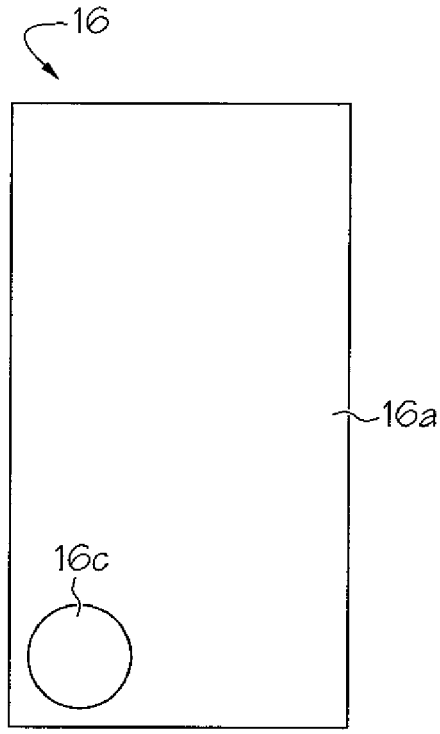
FIG. 3B is a top plan view of the top plate in FIG. 3A.
Figure 14:
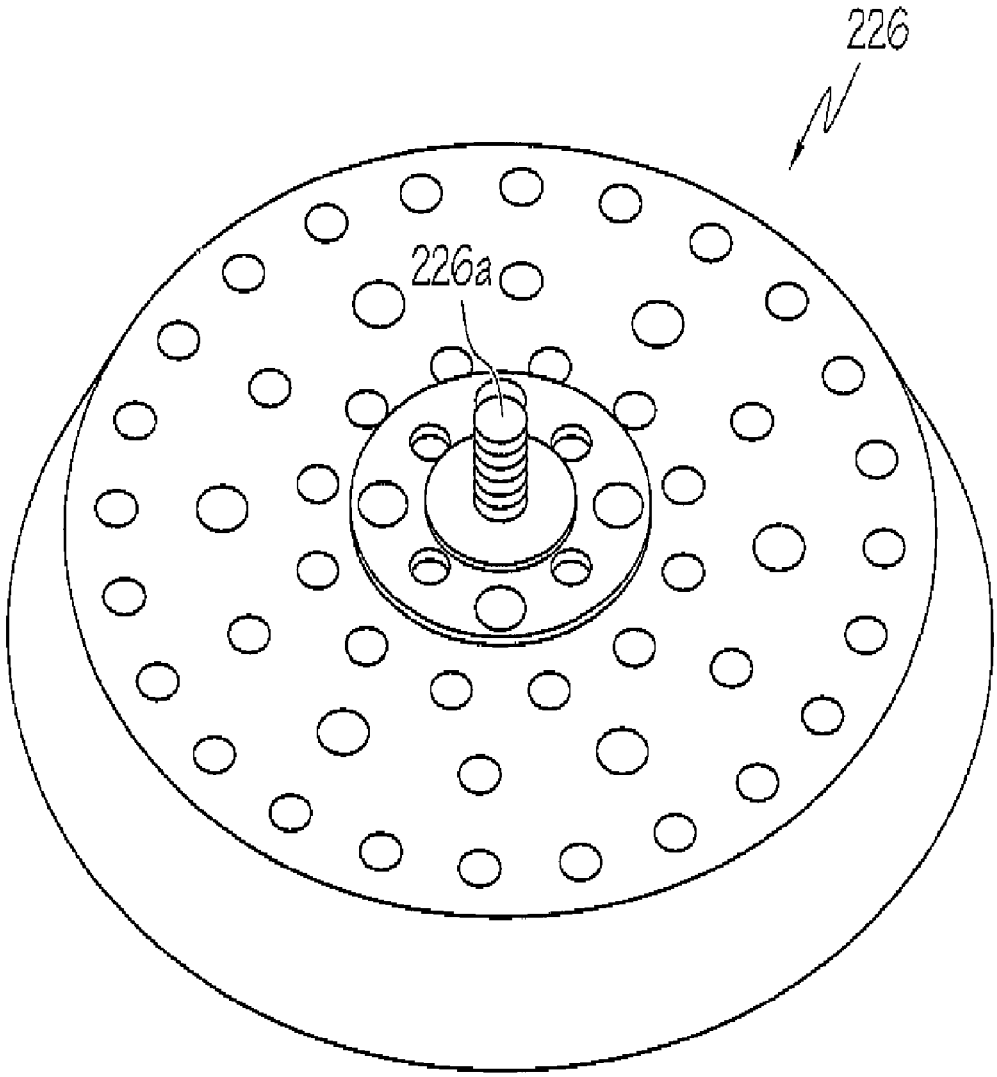
PRIOR ART FIG. 14
FIG. 14 is a perspective view of a conventional sanding pad of a circular mechanical sander.
Figure 15:
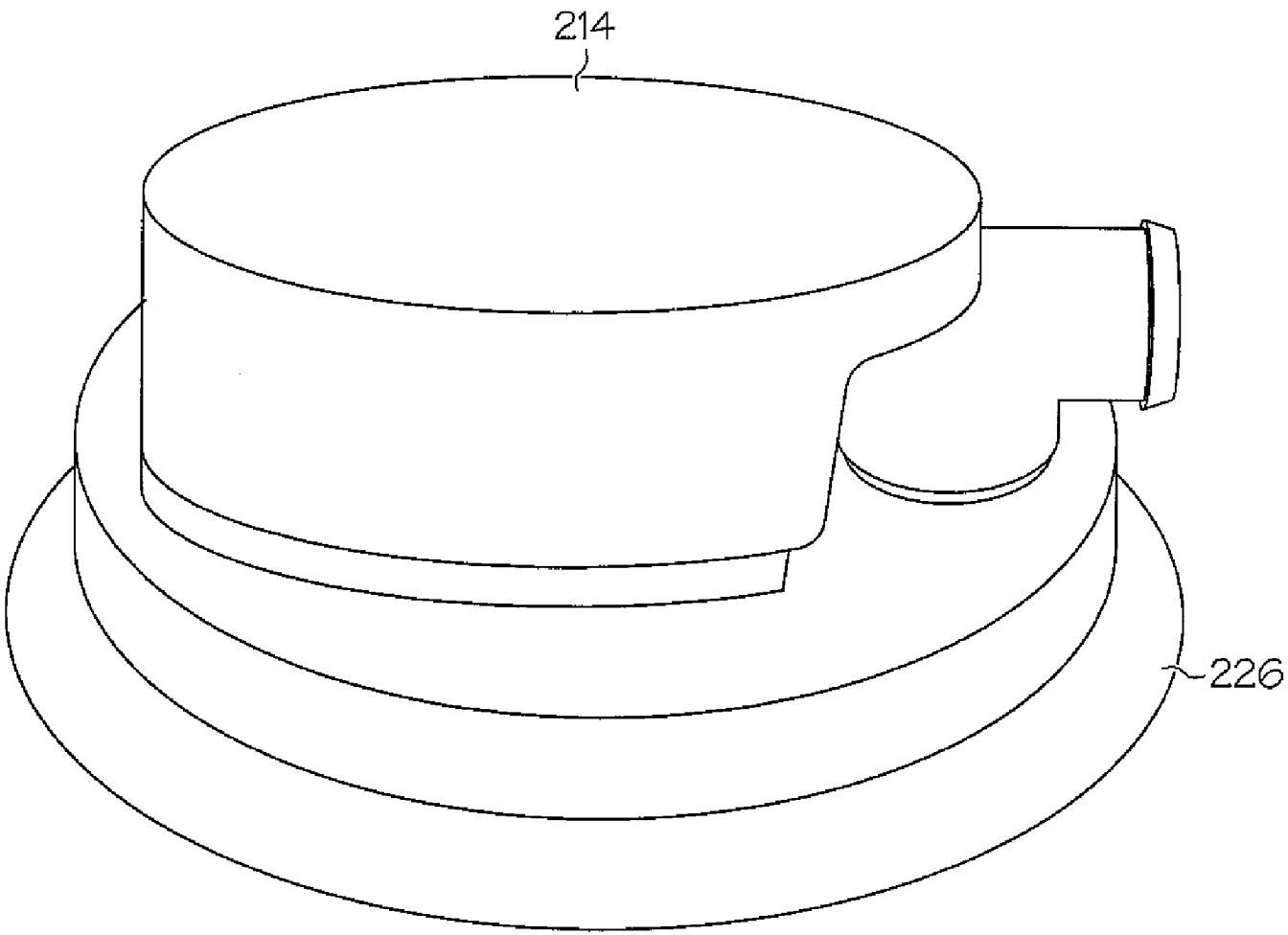
FIG. 15 is a perspective view of the invention of FIG. 2A attached to the conventional sanding pad of FIG. 13.

The handle block 114 and sanding pad 126 may be rectangular in shape as shown in FIGS. 11A, 11B, and 13. In another embodiment of the invention, a handle block 214 and a conventional mechanical sanding pad 226 can be circular in shape as shown in FIGS. 14 and 15. In the circular embodiments illustrated in FIGS. 14 and 15, the sanding pad 226 may feature a single, centrally located stud or screw 226*a* to which the attachment means of the circular handle block 214 may be fastened and secured. FIG. 2B shows an example of an attachment means into which the stud or screw 226*a* of the sanding pad 226 may be attached. This configuration permits a user to remove the conventional sanding pad 226 from the mechanical sander to which it is attached and to reattach the sanding pad 226 to handle block 214 for manual usage in sanding a surface.

In an exemplary embodiment, the handle block (114, 214) can be constructed from a rigid, durable, lightweight material such as, for example, lightweight, high-density foam.

In another embodiment, the sanding device that may feature a handle block for manually grasping the sanding device, a top plate, a center separator plate, a bottom plate, a swiveling connection tube, and a conventional sanding pad. The top plate can be securely attached to a bottom surface of the handle block and includes a top plate aperture extending through a top surface and a bottom surface of the top plate. The center separator plate can be securely attached to the bottom surface of the top plate and includes a center separator plate aperture in communication with the top plate aperture at the bottom surface of the top plate. The bottom plate can be securely attached to a bottom surface of the center separator plate and includes a plurality of bottom plate apertures interconnected by channels, the channels being in communication with the center separator plate aperture. The swiveling connection tube interconnects between a vacuum system and the top plate aperture at the top surface of the top plate. The conventional sanding pad may be of a type that is connectable to a mechanical sander, and can be attached to a bottom surface of the bottom plate. In this embodiment, the handle block,. top plate, center separator plate, and bottom plate can be constructed as a permanently-connected, unitary, single-piece unit that is removably connectable to the sanding pad.

The invention also features a method for sanding a surface and removing by vacuum force the dust and particulate matter produced by the sanding process. This method includes the steps of: (a) attaching a conventional sanding pad of the a type that is connectable to a mechanical sander to a sanding device, wherein. the sanding device is constructed from the parts and in the manner described above; (b) attaching the sanding device to a vacuum system; (c) grasping the sanding device and manually manipulating the sanding device to sand a surface; and (d) removing dust and particulate matter produced during while sanding the surface through the sanding pad and sanding device using negative pressure created by the vacuum system connected to the sanding device.

In an exemplary embodiment of the method, the manual sanding device includes a handle block and a swiveling connection tube. The handle block includes a top surface for manually grasping the handle block, a bottom surface that is attachable to the sanding pad, means for attaching the sanding pad to the bottom surface, and an aperture passing through a side of the top surface and exiting the bottom surface of the handle block. The swiveling connection tube can be attached to the top surface of the handle block at the aperture and is capable of connecting to the vacuum system.

Other Embodiments

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A sanding device comprising:

a handle block for manually grasping the sanding device and comprising a top surface, a bottom surface, and a mounting recess;

a top plate attached to the bottom surface of the handle block and comprising a top surface, a bottom surface, and a top plate aperture in communication with the mounting recess of the handle block, wherein the bottom surface of the top plate further comprises a central channel that begins at the top plate aperture and a longitudinal channel surrounding, but more shallow than, the central channel;

a center separator plate attached to the bottom surface of the top plate and comprising a top surface, a bottom surface, and a center separator plate aperture in communication with the top plate aperture;

a bottom plate attached to the bottom surface of the center separator plate and comprising a top surface, a bottom surface, and a plurality of bottom plate apertures in communication with the center separator plate aperture; and a swiveling connection tube for interconnecting between a vacuum system and the top plate aperture.

2. The sanding device of claim 1, wherein the sanding device further comprises a conventional sanding pad of a type that is connectable to a mechanical sander, wherein the sanding pad is attached to the bottom surface of the bottom plate.

3. The sanding device of claim 2, wherein the handle block and sanding pad are circular in shape.

4. The sanding device of claim 2, wherein the handle block and sanding pad are rectangular in shape.

5. The sanding device of claim 2, wherein the sanding pad is attached to the bottom surface of the bottom plate by at least one fastening means inserted into at least one threaded aperture of the bottom plate.

6. The sanding device of claim 5, wherein the fastening means comprises at least one screw or stud of the sanding pad inserted into the at least one threaded aperture to fasten the sanding device to the sanding pad.

7. The sanding device of claim 1, wherein the bottom surface of the bottom plate further comprises a plurality of recesses, wherein each recess extends from one of the plurality of bottom plate apertures to a longitudinal side of the bottom plate.

8. The sanding device of claim 7, wherein each of the plurality of bottom plate recesses includes side walls that converge from one of the plurality of bottom plate apertures to a narrower opening at the closest longitudinal side of the bottom plate.

9. The sanding device of claim 1, wherein the bottom surface of the top plate further comprises a recess.

10. The sanding device of claim 9, wherein the recess is separated from the central channel and top plate aperture by a ridge that is flush with the bottom surface of the top plate.

11. The sanding device of claim 1, wherein the handle block comprises a rigid, durable, lightweight material.

12. The sanding device of claim 11, wherein the material comprising the handle block is a lightweight, high-density foam.

13. The sanding device of claim 1, wherein the handle block, top plate, center separator plate, and bottom plate comprise a permanently-connected, unitary, single-piece unit that is removably connectable to the sanding pad.

14. The sanding device of claim 1, wherein the top plate is irremovably attached to the handle block to forma single unitary piece.

15. The sanding device of claim 1, wherein the top plate aperture is disposed through the top surface of the top plate so as to be accessible through a mounting recess of the handle block.

16. A method for sanding a surface, the method comprising the steps of: (a) attaching to a manual sanding device a conventional sanding pad of the a type that is connectable to a mechanical sander; (b) connecting the manual sanding device to a vacuum system; (c) grasping the manual sanding device and manually manipulating the sanding device to sand a surface; and (d) removing dust and particulate matter produced during while sanding the surface through the sanding pad and manual sanding device using negative pressure created by the vacuum system; wherein the manual sanding device comprises a handle block for manually grasping the sanding device and comprising a top surface, a bottom surface, and a mounting recess; a top plate attached to the bottom surface of the handle block and comprising a top surface, a bottom surface, and a top plate aperture in communication with the mounting recess of the handle block, wherein the bottom surface of the top plate further comprises a central channel that begins at the top plate aperture and a longitudinal channel surrounding, but more shallow than, the central channel; a center separator plate attached to the bottom surface of the top plate and comprising a top surface, a bottom surface, and a center separator plate aperture in communication with the top plate aperture; a bottom plate attached to the bottom surface of the center separator plate and comprising a top surface, a bottom surface, and a plurality of bottom plate apertures in communication with the center separator plate aperture; and a swiveling connection tube for interconnecting between a vacuum system and the top plate aperture.

* * * * *